United States Patent [19]

Schächter

[11] Patent Number: 4,998,347

[45] Date of Patent: Mar. 12, 1991

[54] SHAVING INSTRUMENT WITH HIGH ENERGY BEAM INDUCED MICROSTRETCH ELEMENT

[76] Inventor: Friedrich Schächter, Draschestrasse 31, Vienna, Austria

[21] Appl. No.: 348,630

[22] Filed: May 8, 1989

[51] Int. Cl.[5] ..... B26B 19/42

[52] U.S. Cl. ..... 30/34.2; 30/81

[58] Field of Search ..... 30/34.2, 77, 78, 81, 30/82

[56] References Cited

U.S. PATENT DOCUMENTS

| | | | |
|---|---|---|---|
| D. 174,036 | 2/1955 | Glaberson | D22/3 |
| D. 202,427 | 9/1965 | Ferrier, Jr. | D22/3 |
| D. 229,876 | 1/1974 | Glaberson | D28/3 |
| D. 241,583 | 9/1976 | Gifu | D28/3 |
| D. 242,661 | 12/1976 | Gray | D28/3 |
| D. 245,460 | 8/1977 | Poisson . | |
| D. 248,578 | 7/1978 | Byrne . | |
| D. 249,968 | 10/1978 | Kiraly . | |
| D. 255,387 | 6/1980 | Glaberson . | |
| 2,048,565 | 7/1936 | Rodriges | 30/83 |
| 2,349,252 | 5/1944 | Douglass | 30/122 |
| 3,172,202 | 3/1965 | Sooter | 30/90 |
| 3,399,455 | 9/1968 | Steere, Jr. | 30/90 |
| 3,786,563 | 1/1974 | Dorion et al. | 30/83 |
| 4,502,217 | 3/1985 | Schachter | 30/82 |

FOREIGN PATENT DOCUMENTS 64526 4/1980 Greece .

*Primary Examiner*—Douglas D. Watts

*Attorney, Agent, or Firm*—Pennie & Edmonds

[57] ABSTRACT

In a shaving instrument including a razor blade having an edge attached to one end of a support and a guard bar arranged in precise spaced relation parallel to said razor blade edge, the improvement of a patterned texture on a region of an outer surface of the guard bar, the texture including one or more depressions each having a mound of minute height which constitutes a border of each depression, the material of each mound formed by a solidified part of the material which was melted and displaced from the guard bar to form the depressions; the texture being positioned such that when the shaving instrument is slidingly applied to skin having hair extending therefrom, the texture exerts a degree of drag or friction thereto which causes the skin to be pulled slightly and the hair to be properly positioned for cutting by the blade edge. The texture is imprinted upon the guard bar by a high energy beam, preferably from a YAG-Nd laser.

31 Claims, 2 Drawing Sheets

SHAVING INSTRUMENT WITH HIGH ENERGY BEAM INDUCED MICROSTRETCH ELEMENT

TECHNICAL FIELD

The invention relates to a shaving instrument having at least one razor blade firmly attached to a base part or handle which is provided with a guard bar arranged in front of the blade cutting edge for contact with the skin of the user. The guard bar exerts a degree of drag or friction to cause the skin to be pulled slightly so that the hair is properly positioned for cutting by the razor blade edge. This shaving instrument may also include a cover plate provided with a glide surface which faces the skin and is positioned rearward of the razor blade edge to promote sliding across the skin of the user.

BACKGROUND OF THE INVENTION

The quality of a shaving instrument not only depends upon the exact position of the blade cutting edge relative to the face but also on the effectiveness of the guard bar to properly stretch and knead the skin and orient hair in correct position for optimum cutting by the blade edge.

One of the first patents to recognize this problem and suggest a solution is U.S. Pat. No. 2,048,565 to Rodrigues. In this patent, a safety razor is provided with a guard to impart a certain degree of friction upon the face of the user to cause the proper passage or what he calls "flow" of skin from the guard to the cutting edge of the blade. This razor guard presents the section of skin being shaved to the blade edge with the shaft of the hair extending out of the skin as far as possible when the edge of the blade sliding over the lather lubricated skin comes in contact with the hair. In effect, the action of the guard bar is likened to taking the portion of the skin immediately ahead of the blade edge between the fingers of the user and gently but firmly pressing it into a slightly convex form which naturally projects the shaft of the hair out of the cuticle as far as its roots will permit. The guard bar of this patent has a knurled or roughened area which contacts the skin to cause a slight accumulation of skin ahead of the bar.

A later development is disclosed in U.S. Pat. No. 2,349,252 to Douglass, wherein a wire guard is bent to a wavy or corrugated form which contacts the skin of the user prior to the razor blade.

Greek Patent No. 64526 to Gyllerstrom discloses a razor having a front bar which is mechanically or chemically treated to have pores, knurls, lines or other surface features to increase the friction upon the skin while shaving.

U.S. Pat. No. 4,502,217 to Schachter discloses a guard bar having a plurality of elements which are formed by coining, thereby displacing substantial amounts of material to achieve sharp edges extending parallel to the bar. These elements may be arranged symmetrically and are positioned on the surface portion of the guard bar which faces the blade in front of a tangential plane extending through the blade cutting edge and the surface of the guard bar. These teeth provide the necessary friction effects on the skin of the user.

In each of these prior art devices, the teeth or roughened area of the bar cannot be uniformly reproduced, since the tools used to form such teeth or roughened areas wear. This difficulty in preparing uniform roughening causes the guard bar to have unpredictable or ineffective areas which cannot achieve the desired results.

The present invention provides a novel method of manufacturing guard bars having a uniform texture for providing proper friction and drag on the skin of the user to facilitate optimal hair removal therefrom.

SUMMARY OF THE INVENTION

The invention relates to improvements in the guard bar of a shaving instrument which includes a razor blade having an edge attached to one end of a support and a guard bar arranged in precise spaced relation parallel to the razor blade edge. This improvement comprises a patterned texture on a region of an outer surface of the guard bar, wherein the texture includes one or more depressions each having a mound of minute height which constitutes a border of each depression. The material of each mound is formed by a solidified part of the material which was melted and displaced from the guard bar to form the depressions. The texture is positioned such that when the shaving instrument is slidingly applied to skin having hair extending therefrom, the texture exerts a degree of drag or friction thereto which causes the skin to be pulled slightly and the hair to be properly positioned for cutting by the blade edge.

In one embodiment, the depression includes at least one groove. A plurality of such grooves each oriented essentially parallel to the blade edge may be used. In addition, a single groove in the form of a meander is also useful. For either embodiment, a mound of resolidified material which has been removed from the groove is present on at least one side of the groove to define its boundary or outline.

A further embodiment relates to depressions which comprise a plurality of arcuate craters having an outline formed by the narrow mound. These craters may be positioned in a line essentially parallel to the blade edge, or arranged in a two dimensional pattern. Also, the craters may be positioned in a line which follows the configuration of a meander. This improvement is obtained by preparing the patterned texture upon an outer surface of the guard bar with a high energy beam. The bar is then assembled bar onto the shaving instrument so that the patterned texture is positioned for contact with skin along a tangent extending between the blade edge and the texture. Generally, the texture is prepared before assembling the guard bar onto the shaving instrument, and can include any of the types of depressions mentioned above.

In operation, the high energy beam melts and partially evaporates the material of the guard bar to form the depression or depressions and the mound is formed by resolidification of a portion of the molten and condensed guard bar material. The most preferred high energy beam is a laser beam, and it is oscillated relative to the guard bar to prepare the texture, generally by rocking laser beam reflecting means, preferably a mirror or mirrors, and/or by moving the guard bars, to direct the beam upon the guard bar in the desired location.

BRIEF DESCRIPTION OF THE DRAWINGS

Further benefits and advantages of the invention will become apparent from a consideration of the following description given with reference to the accompanying drawing figures which specify and show preferred embodiments of the invention and wherein.

DETAILED DESCRIPTION OF THE PREFERRED EMBODIMENTS

The invention disclosed in this application is an improvement upon the inventor's prior U.S. Pat. No. 4,502,217, the disclosure of which is expressly incorporated herein by reference thereto specifically with regard to the position of the shaving head upon the shaving instrument, as well as to the attachment of the guard bar to the shaving head.

Figure 1:
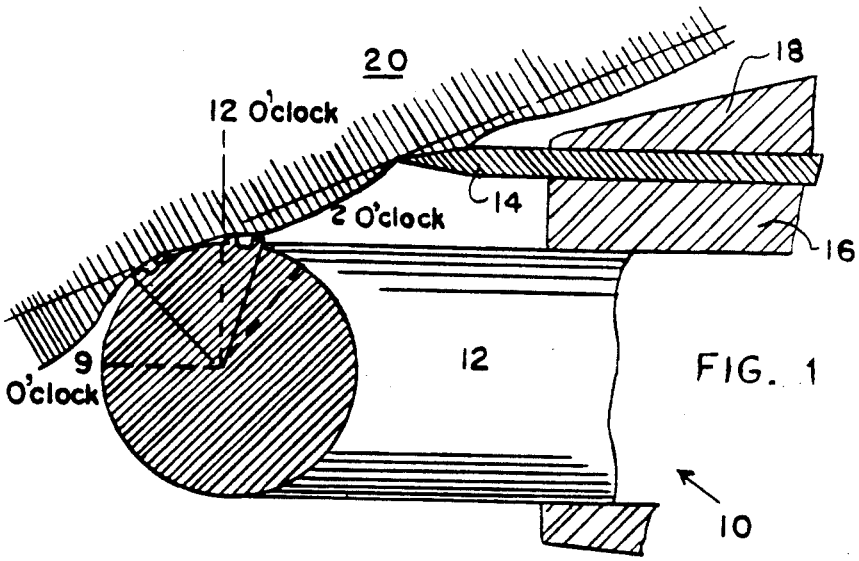
FIG. 1 is an enlarged section illustrating the contact of the guard bar and blade upon the skin of a user of the shaving instrument of the invention.

Referring now to FIG. 1, there is illustrated a shaving head 10 including guard bar 12, razor blade 14, base member 16 and cover member 18. Razor blade 14 is firmly clamped between base member 16 and cover 18 and cannot be exchanged. The base member 16 is firmly attached to a handle member, which is preferably made of a plastic material.

Figure 2:
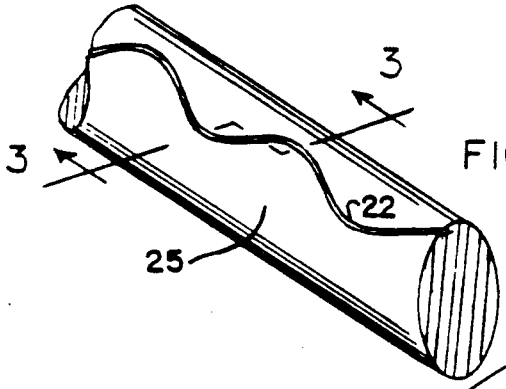
FIG. 2 is an enlarged section of the guard bar illustrating the texture thereon.
Figure 3:
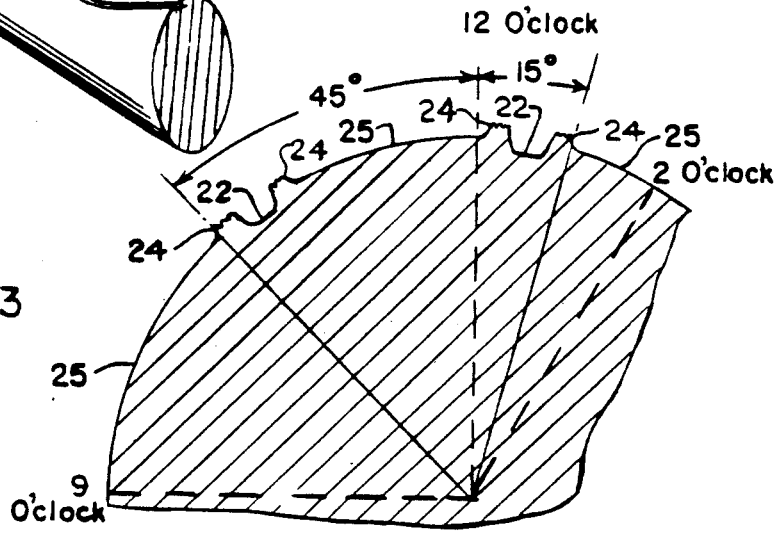
FIG. 3 is an enlarged, partial cross-sectional view of the guard bar taken along lines 3—3 of FIG. 2.
Figure 4:
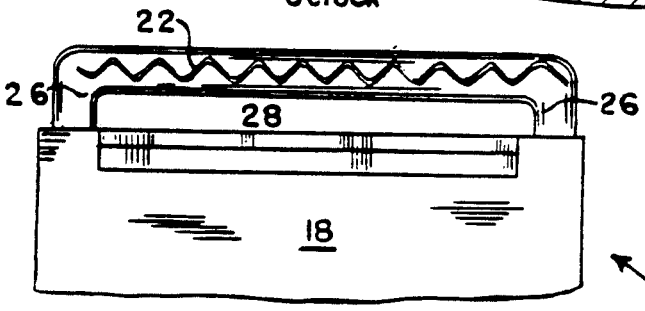
FIG. 4 is a top view of the shaving instrument of the invention to illustrate the top cover and guard bar.
Figure 5:
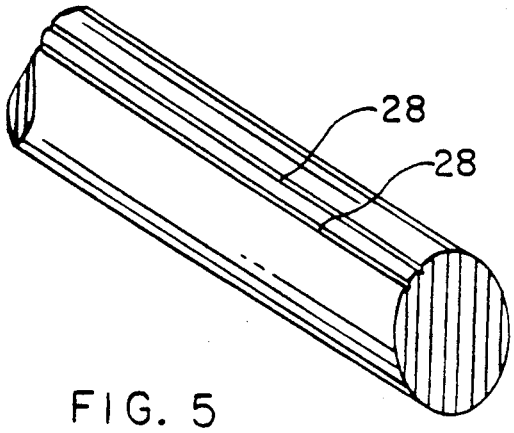
FIG. 5 is an enlarged section of a guard bar having a texture of two parallel grooves.

This guard bar 12 is provided with what may be termed microstretch elements constituting recessed portions 22 as best illustrated in FIGS. 2 and 3, and raised textured mounds 24 as best illustrated in FIG. 3. Recessed portions 22 have narrow mounds on their boundaries and form a meander or wavy line as they extend across the exterior surface 25 of the guard bar for engagement with the skin 20 of the user of the shaving instrument.

These grooves 22 and raised mounds 24 are provided by a high energy beam, such as that of a laser or the like. The laser beam provides uniform, exactly reproducible groove and mound patterns upon the guard bar so long as suitable operating parameters are established and maintained, while the coined, stamped or embossed patterns, which have previously been provided as the roughened surface of the guard bars, were produced by tools subject to wear which results in non-uniform and uncontrolled textures. The textures obtained by chemical and/or abrasive treatments are also uncontrollable erosions. Such erosive removals of material from the surface of the bars are substantially dependent upon grain structure and may decrease, rather than increase, the desired friction upon the skin.

In the manufacturing sequence, a wire of approximately the same dimensions as disclosed in the inventor's earlier U.S. Pat. No. 4,502,217 has its end portions 26 bent at right angles thereto for initial orientation with respect to the laser beam and future positioning in the shaving head 10. Thereafter, a series of adjacently aligned guard bars pass below a YAG-Nd laser. This laser is of the type which is conventionally used to scribe lines, text or alpha-numeric characters on steel or other metals. This laser is operated at a power output of between 30 and 60 watts and is focused to a beam of between 0.005 to 0.015 millimeters diameter so as to provide a groove width of about 50 to 150 microns and a depth of between about 3 and 8 microns below the original guard bar surface. The mounds outlining each groove consist of a resolidified portion of the material removed to create the groove, and have a height of between about 1 and 3 microns above the original surface, and a width of 3 to 10 microns. The topography of the textured mounds includes surface features forming millions of submicroscopic peaks per square millimeter which can be observed, for example, by a scanning tunneling microscope. The energy input from the laser beam should be such that the macroscopic shape of guard bars are not substantially deformed therefrom.

The relative speed of movement in the X and Y directions between the guard bars and the laser beam can be as desired to impart a meander configuration upon the surface of the bar. Speeds between about 10 and 200, and preferably between 40 and 100, millimeters per second, provide acceptable groove and mound configurations. Generally, the guard bars are moved relative to the laser beam in a slot or other fixture capable of orienting the desired portion of the guard bar exterior surface to the beam. The laser beam is oscillated in a Y-direction across the surface of the guard bar by a rocking motion of a mirror or other laser reflecting source, or by moving the guard bar in the Y direction as it passes under the laser beam, produces a 0.8 millimeter band in the Y-direction. Alternately, an imprint of the meander across a 60° arc of the guard bar surface can be used, as shown in FIG. 3.

The energy of the laser beam causes a portion of the surface of the guard bar to be melted and vaporized to form the groove 22, with side mounds 24 being formed by solidification of a part of this melted guard bar material. The meander 22 is provided on the exterior surface of the guard bar in orientation for optimum contact with the skin of the user of the shaving instrument. If the line at which the guard bar outer surface is perpendicular to the razor blade is assumed to represent a twelve o'clock position, then the most preferred usable region of the guard bar outer surface would be a band spanning a 60 degree circumference ranging from 45 degrees on the counterclockwise side of the twelve o'clock position and to 15 degrees on the clockwise side, as shown in FIG. 3. However, depending upon the nature of the texture desired for imparting the appropriate surface friction and drag, the meander 22 can be placed on any region of the outer surface of the guard bar from a position of nine o'clock to and including two o'clock relative to the twelve o'clock position stated above, as shown in FIG. 1.

The width of the groove 22 and the height of the side mounds 24 can be varied to provide different effects upon the skin of the user. While the focus of the laser beam normal to the surface of the guard bar results in a groove having substantially symmetrical mounds on each side, a variation of the incident angle of the beam, such as by applying the beam at a tangential direction, could result in a groove or depression having uneven or one sided mounds.

Instead of an elongated groove 22 in the meander configuration, it is also possible to utilize the laser beam to make a plurality of discrete craters or dots upon the surface of the guard bar in the desired position with respect to the skin of the user. These dots can be round, oval or arcuate, discrete as mentioned above, or partially touching or overlapping each other.

Figure 6:
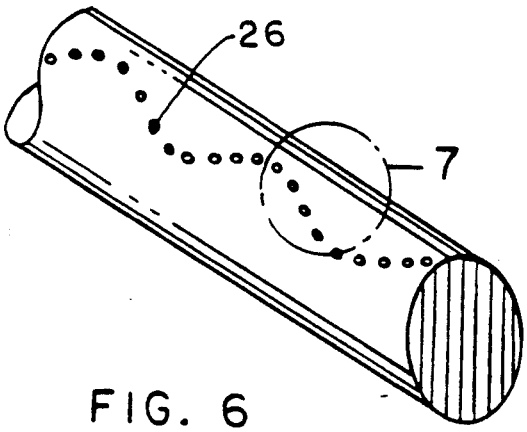
FIG. 6 is an enlarged section of a guard bar having a texture of a plurality of discrete craters.
Figure 7:
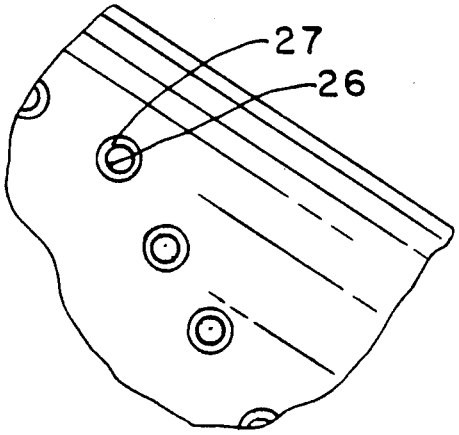
FIG. 7 is an enlarged section of a portion of the guard bar of FIG. 6.

A plurality of discrete arcuate craters 26 in the meander configuration is shown in FIGS. 6 and 7. FIG. 7 illustrates the mound boundary 27 which is formed around the circumference of each crater 26.

It is also possible to use instead of a meander a plurality of straight lines each of which are formed by the groove 22 and the mound boundaries 24 as described above with regard to the meander. The importance of the use of the laser in forming these shapes or designs is that some of the material which is liquified by the laser beam forms the mounds, and that these mounds form a periphery or boundary on at least one side of the depression. Thus, after continuously applying or pulsing the beam, by varying the focus of or the current supplied to the beam, or by controlling the movement of the part relative to the beam, a wide variety of closely controlled shapes, configurations and textures can be obtained, all of which contemplated by the present invention.

Although the preferred material for the guard bar is currently stainless steel, it is conceivable that the bar can be made of other metals such as steel, aluminum, copper, nickel or metallic alloys. Also, it is possible to utilize engineering plastics which have a high stiffness and sufficient mechanical strength for providing the appropriate degree of friction and drag upon the skin of the user without the texture being changed during the useful life of the shaving instrument. Suitable plastics include the engineering thermoplastics and in particular, a new type material known as the aromatic polyester liquid crystal polymers. These liquid crystal polymers are sold by Dupont under the tradename HX 3000 High Temperature Thermoplastic Polyester Resins. In addition to the 3000 grade, it is also possible to use either the 2000 or 4000 grade, all with or without glass reinforcement. It is believed that glass or other reinforcement is not necessary to enhance the appropriate mechanical strength of the plastic material, but it may be advantageous to utilize such reinforcement in order to provide additional abrasion characteristics to the groove 22 and mounds 24 to assist in providing the appropriate degree of tension, friction and drag upon the skin of the user.

As noted in inventor's earlier patent, the distance between the texture surface of the guard bar and the razor blade should be maintained at between about 1 and 2 millimeters to allow for cut hair and skin lubricants (i.e. soap or shaving cream) to be removed while the blade is passing over the skin. This distance facilitates instant cleaning and removal of the hair and lubricants from the blade.

Thus, it can be seen that, by use of the guard bar and shaving instrument according to the present invention, a formation of the skin surface which presents the hair properly to the cutting edge of blade is achieved. This skin is deformed by the pressure of the razor and guard bar against the face, plus the movement of the guard bar across the skin to extent that it causes a proper positioning of the skin at the point contacted by the blade. In addition, the guard bar provides a degree of drag or friction which causes the proper passage for what is termed, according to the invention of the Rodriques patent, the "flow" of skin from the guard bar to the cutting edge of the blade. This feature can now be achieved by the novel and uniformly controlled texture provided by the present invention.

The invention is applicable to various forms of shaving instruments but has been illustrated as applicable to a disposable unit having a single edge flat blade on a platform. However, the invention should not be limited beyond the true spirit and scope of the appended claims as interpreted by those skilled in the art having this specification before them.

What is claimed is:

1. In a shaving instrument including a razor blade having an edge attached to one end of a support and a guard bar arranged in precise spaced relation parallel to said razor blade edge, the improvement which comprises a patterned texture on a region of an outer surface of said guard bar, said texture including one or more depressions each having a mound of minute height which constitutes a border of each said depression, the material of each said mound formed by a solidified part of the material which was melted and displaced from said guard bar to form said depressions; said texture being positioned such that when the shaving instrument is slidingly applied to skin having hair extending therefrom, said texture exerts a degree of drag or friction thereto which causes the skin to be pulled by said blade edge; wherein the depressions have a depth of between about 3 and 8 microns below the original guard bar surface and a width of between about 50 and 150 microns, while the mounds have a height of between about 1 and 3 microns above the original guard bar surface and a width of about 3 to 10 microns.

2. The shaving instrument of claim 1 wherein said depression includes at least one groove.

3. The shaving instrument of claim 2 wherein said depression includes a plurality of grooves oriented essentially parallel to said blade edge.

4. In a shaving instrument including a razor blade having an edge attached to one end of a support and a guard bar arranged in precise spaced relation parallel to said razor blade edge, the improvement which comprises a patterned texture on a region of an outer surface of said guard bar, said texture including one or more depressions each having a mound of minute height which constitutes a border of each said depression, the material of each said mound formed by a solidified part of the material which was melted and displaced from said guard bar to form said depressions; said texture being positioned such that when the shaving instrument is slidingly applied to skin having hair extending therefrom, said texture exerts a degree of drag or friction thereto which causes the skin to be pulled slightly and the hair to be properly positioned for cutting by said blade edge; wherein said one or more depressions each follow the configuration of a meander.

5. The shaving instrument of claim 2 wherein said mound is present on each side of said groove.

6. The shaving instrument of claim 4 wherein said depressions comprise a plurality of discrete craters having an outline formed by said mound.

7. The shaving instrument of claim 1 wherein said depressions comprise a plurality of discrete craters which are positioned in a line essentially parallel to said blade edge.

8. The shaving instrument of claim 1 wherein said depressions comprise a plurality of discrete craters which are arranged in a two dimensional pattern.

9. In a shaving instrument comprising a handle, a razor blade having an edge and attached to the end of the handle, and a guard bar arranged in precise spaced relation parallel to said razor blade edge, the improvement which comprises producing a patterned texture upon an outer surface of said guard bar with a high energy beam.

10. The improvement of claim 9 which further comprises assembling said guard bar onto said shaving instrument so that said patterned texture is positioned for contact with skin along a tangent extending between said blade edge and said guard bar patterned texture.

11. The improvement of claim 10 wherein said texture is prepared before assembling said guard bar onto said shaving instrument.

12. The improvement of claim 9 which further comprises forming said texture to include one or more depressions each having a mound of minute height which constitutes a border of each depression.

13. The improvement of claim 12 wherein said high energy beam melts the material of said guard bar to form said one or more depressions and said mound is formed by solidification of a portion of the melted guard bar material.

14. The improvement of claim 9 wherein said high energy beam is a laser beam.

15. The improvement of claim 14 which further comprises oscillating said laser beam to prepare said texture.

16. The improvement of claim 15 wherein said laser beam is oscillated by rocking laser beam reflecting means.

17. The improvement of claim 12 wherein said depression includes at least one groove.

18. The improvement of claim 17 wherein said depression includes a plurality of grooves oriented essentially parallel to said blade edge.

19. In a shaving instrument comprising a handle, a razor blade having an edge and attached to the end of the handle, and a guard bar arranged in precise spaced relation parallel to said razor blade edge, the improvement which comprises producing a patterned texture upon an outer surface of said guard bar with a high energy beam wherein said texture includes one or more depressions each having a mound of minute height which constitutes a border of each depression and each said one or more depressions follow the configuration of a meander.

20. The improvement of claim 17 wherein said mound is present on each side of said groove.

21. The improvement of claim 19 wherein said depressions comprise a plurality of discrete craters having an outline formed by said mound.

22. The improvement of claim 12 wherein said depressions constitute a plurality of discrete craters which are positioned in a line essentially parallel to said blade edge.

23. The improvement of claim 12 wherein said depressions constitute a plurality of discrete craters which are arranged in a two-dimensional pattern.

24. A shaving instrument comprising a base part of a plastic material, at least one razor blade having a cutting edge placed on said base part, a cover part attached to said base part so that said razor blade is clamped between said base part and said cover part, said cover part having a glide surface facing the skin to be shaven and away from said base part and ending at a distance from said cutting edge of said razor blade, a guard bar coming into contact with the skin and arranged spaced and parallel to said cutting edge of said razor blade, wherein said guard is composed of a length of calibrated wire whose nominal diameter ranges from between 1.2 and 2.2 mm, said wire being bent at its ends to provide legs arranged at angles to a central straight portion having a mantle surface, said legs connected to one of said base part and said cover part, at least two lugs connected to one of said base part and said cover part providing abutments for maintaining the position of said guard bar relative to said cutting edge of said razor blade, one of said base part and said cover part defining recesses opening toward said guard bar for receiving said legs of said guard bar, and patterned textured elements on a region of said guard bar mantle surface intended to come into contact with the skin, said textured elements including depressions being outlined by mounds of minute height which constitute a border contour of each said depression, the material of said mound formed by a solidified part of the material which was melted and displaced from said guard bar to form said depressions; said textured elements being positioned such that when the shaving instrument is slidingly applied to skin having hair extending therefrom, said texture exerts a degree of drag or friction thereto which causes the skin to be pulled and stretched, thereby avoiding a wave of skin to be formed between the cutting edge and the guard and to cause the hair to be properly positioned for cutting by said blade edge.

25. The shaving instrument of claim 24 wherein the textured elements are provided on said guard bar by a high energy laser beam.

26. The shaving instrument of claim 25 which further comprises forming said textured elements to include depressions each having a mound of minute height which constitutes a border contour of each depression.

27. The shaving instrument of claim 26 wherein said high energy laser beam melts the material of said guard bar to form said depressions and said mound is formed by solidification of a portion of the melted guard bar material.

28. The shaving instrument of claim 27 wherein the textured elements are placed between a 9 o'clock and 2 o'clock position in the guard bar, wherein the 12 o'clock position is the point at which the guard bar mantle surface is perpendicular to the razor blade.

29. The shaving instrument of claim 28 wherein the depressions have a depth of between about 3 and 8 microns below the original guard bar surface and a width of between about 50 and 150 microns, while the mounds have a height of between about 1 and 3 microns above the original guard bar surface and a width of about 3 to 10 microns.

30. The shaving instrument of claim 4 wherein the depressions having a depth of between about 3 and 8 microns below the original guard bar surface and a width of about 50 and 150 microns, while the mounds having a height of between about 1 and 3 microns above the original guard bar surface and a width of about 3 to 10 microns.

31. The improvement of claim 9 wherein the depressions having a depth of between about 3 and 8 microns below the original guard bar surface and a width of about 50 and 150 microns, while the mounds have a height of between about 1 and 3 microns above the original guard bar surface and a width of about 3 to 10 microns.

* * * * *